US005924894A

United States Patent [19]

Perroncel

[11] Patent Number: 5,924,894

[45] Date of Patent: Jul. 20, 1999

[54] SIGNAL PROCESSING CIRCUIT

[75] Inventor: Alain Perroncel, Villefontaine, France

[73] Assignee: Radiall, Rosny-Sous-Bois, France

[21] Appl. No.: 08/747,561

[22] Filed: Nov. 12, 1996

Related U.S. Application Data

[30] Foreign Application Priority Data

Nov. 13, 1995 [FR] France ..... 95 13397

[51] Int. Cl.[6] ..... H01R 13/719

[52] U.S. Cl. ..... 439/620

[58] Field of Search ..... 174/52.1; 360/740, 360/747, 759, 801, 825; 439/68, 620

[56] References Cited

U.S. PATENT DOCUMENTS

| | | | |
|---|---|---|---|
| 4,477,144 | 10/1984 | Huang | 439/581 |
| 4,633,359 | 12/1986 | Mickelson et al. | 361/119 |
| 4,668,032 | 5/1987 | Bouvier et al. | 439/68 |

FOREIGN PATENT DOCUMENTS

| | | |
|---|---|---|
| 0205367 | 3/1981 | European Pat. Off. . |
| 4206433 | 9/1993 | Germany . |
| 9521481 | 8/1995 | WIPO . |

*Primary Examiner*—Neil Abrams

*Attorney, Agent, or Firm*—Schweitzer Cornman Gross & Bondell LLP

[57] ABSTRACT

A signal processing module (31) suitable for being inserted into a substantially cylindrical cavity (32) into which there penetrate at least two electrical conductors (26, 28). The module (31) includes a substrate (6) having first and second edges that are opposite about a first direction and third and fourth edges likewise opposite but about a second direction substantially perpendicular to the first, a signal processing circuit formed on the substrate and a first pair of resilient tabs (2) electrically connected to a signal processing circuit, one resilient tab formed on the first edge and the other on the second edge of the substrate. On its third and fourth edges, the substrate carries a second pair of resilient tabs (3) suitable for deforming towards each other, with the spread of the module being slightly greater than the largest dimension of the cross-section of the cavity such that the second pair of resilient tabs (3) of the module are pressed against the wall of the cavity when the module is inserted therein with its second direction extending substantially parallel to the axis of the cavity, and holding the substrate firmly in position in the cavity. The first pair of tabs (2) are in electrical connection with the two electrical conductors (26, 28). The second pair of tabs (3) are in electrical connection with the wall of the cylindrical cavity which can be an electrically conductive shell (21). Solder (13) is used to connect the two tracks (7, 10) of the signal processing circuit to the resilient tabs (3, 2).

6 Claims, 2 Drawing Sheets

SIGNAL PROCESSING CIRCUIT

The present invention relates to a signal processing circuit suitable for being housed in a cavity, and in particular in a coaxial connector.

BACKGROUND OF THE INVENTION

In order to attenuate, filter, or clip a signal conveyed by a coaxial line, it is known to interpose a signal processing circuit in the line.

One of the methods used for interposing such a circuit consists in housing a signal processing module in a coaxial connector, with the module being enclosed in an inside cavity of the connector.

The cavity is inaccessible from the outside and has at least two substantially facing electrical conductors penetrating into it.

In general, the cavity is integrally formed in a conductive material which is itself electrically connected to the outer conductor of the coaxial line.

The signal processing module generally comprises a substrate carrying a circuit that includes signal processing functions such as attenuation, clipping, or filtering, for example.

The tracks of the circuit terminate at contact terminals located on the edges of the substrate, preferably at opposite ends so that, when the module is engaged in the cavity, each terminal is in the vicinity of one of the electrical conductors that penetrates therein.

The substrate is held in the cavity by fixing means such as tabs or clips on the walls of the cavity.

Each contact terminal is electrically connected to the corresponding electrical conductor penetrating into the cavity either by soldering or by a male-female type connection or by crimping.

A major drawback of such prior processing modules lies in the fact that installing and fixing a module in a cavity are operations that are relatively expensive.

Not only is it necessary to provide fixing means in the cavity to enable it to receive and hold the signal processing module, but it is also necessary to make electrical connections between the electrical conductors penetrating into the cavity and the contact terminals of the circuit formed on the substrate.

Also, in addition to this problem of cost, such known devices also suffer from a problem of reliability.

Solder joints, male-female type connections, and crimping as performed between the contact terminals of the signal processing module and the electrical conductors penetrating into the cavity tend to break because of the stresses to which they are subjected due to the thermal expansions of the various materials constituting the conductor, or because of the forces transmitted by the connection interfaces of the connector when the connector is engaged with another connector.

OBJECTS AND SUMMARY OF THE INVENTION

The present invention seeks to solve the above-outlined drawbacks by proposing a signal processing module which is suitable for being housed in any cavity without prior preparation thereof, and which connects automatically with electrical conductors penetrating into the cavity without requiring any soldering or special connections.

The present invention provides a signal processing module suitable for being inserted in a substantially cylindrical cavity defining an axis and into which there penetrate at least two electrical conductors situated substantially facing each other, the module comprising:

- a substrate having first and second edges opposite to each other about a first direction of the substrate, and third and fourth edges likewise opposite each other but about a second direction of the substrate substantially perpendicular to the first direction;
- a circuit formed on the substrate for signal processing; and
- at least two contact terminals whereby a signal can pass through the circuit, one being formed on the first edge of the substrate and the other on the second edge of the substrate;

wherein, on its third and fourth edges the substrate includes resilient tabs suitable for deforming on moving towards each other, the spread of the module, i.e. the distance between the two furthest-apart points of the two resilient tabs when at rest, being slightly greater than the largest dimension of the cross-section of the cavity, such that the resilient tabs of the module are pressed against the wall of the cavity when the module is inserted therein with its second direction substantially parallel to the axis of the cavity, and hold the substrate firmly in position in the cavity.

In a preferred embodiment of the invention, in which the cavity is made of a conductive material and is connected to the outer conductor of the coaxial line while the electrical conductors penetrating into the cavity are insulated therefrom, the resilient tabs are made of an electrically conductive material and are electrically connected to the signal processing circuit.

In a particular embodiment of the invention, on its first and second edges, the substrate includes other resilient tabs constituting contact terminals enabling a signal to pass through the processing circuit.

These other resilient tabs are preferably paired, with the two tabs in each pair being opposite each other in the first direction of the substrate. They thus bear naturally against the end faces of the electrical conductors penetrating into the cavity, thus providing electrical connection of said electrical conductors to the signal processing circuit of the substrate.

In a variant, the coaxial line has a plurality of central conductors. It can then also be referred to as a shielded multiconductor line, and the signal processing module of the invention then comprises both a plurality of pairs of contact terminals, each pair comprising one terminal on the first edge of the substrate and one terminal on the second edge of the substrate, and also a pair of resilient tabs on the third and fourth edges of the substrate.

The present invention also provides a method of making a signal processing module as described above.

The method consists in:

- cutting a thin metal sheet to form parts suitable for folding to form resilient tabs, said parts remaining attached to the thin metal sheet via narrow breakable bridges of material;
- folding the parts to form said resilient tabs;
- placing the substrate on which the processing circuit has previously been formed onto the thin metal sheet between the resilient tabs and soldering it thereto; and
- breaking the narrow breakable bridges of material holding the resilient tabs formed in this way to the thin metal sheet.

BRIEF DESCRIPTION OF THE DRAWINGS

In order to make the invention easier to understand, there follows a description of an embodiment that is given by way of non-limiting example and made with reference to the accompanying drawings, in which.

MORE DETAILED DESCRIPTION

Figure 1:
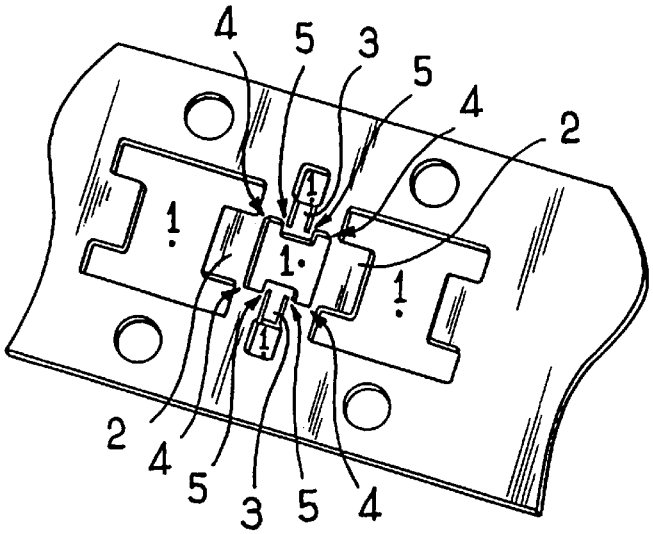
FIG. 1 is a plan view of a thin metal sheet in which the resilient tabs of a module of the invention are cut out.
Figure 2:
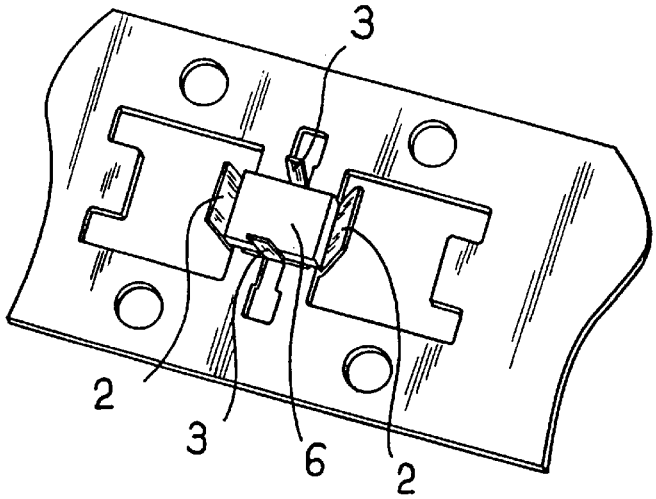
FIG. 2 is a view analogous to FIG. 1 after the resilient tabs have been folded and the substrate put into place.

The thin metal sheet shown in FIGS. 1 and 2 is made of beryllium copper.

In the present example it is in the form of a continuous strip.

Holes are made in certain portions 1 of the strip, e.g. by punching, so as to leave parts 2 and 3 that are suitable, after being folded, for forming the resilient tabs of a module of the invention.

It will be observed that the parts 2 and 3 are secured to the thin metal sheet by narrow bridges of material 4 and 5 which are sufficiently fragile to break easily on bending.

These narrow bridges of material constitute breakable connections for a purpose described below.

The parts 2 and 3 are then folded that their portions remote from the breakable connections 4 and 5 project upwards, as shown in FIG. 2.

When folded in this way, the parts 2 and 3 constitute the resilient tabs within the meaning of the invention.

A substrate 6 having a signal processing circuit formed thereon, e.g. an attenuation circuit, is placed inside the space defined by the resilient tabs 2 and 3.

Figure 3:
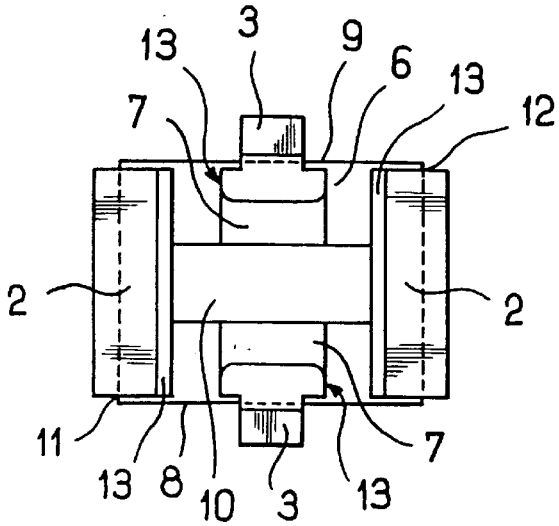
FIG. 3 is a plan view of the module separated from the thin metal sheet.

As can be seen in FIG. 3, the signal processing circuit formed on the substrate 6 comprises a conductive track 7 which extends between a first edge 8 of the substrate and a second edge 9 of the substrate opposite to the first edge 8, said conductive track 7 being interrupted in its middle portion by a track 10 of controlled characteristic resistance and impedance and extending between a third edge 11 of the substrate and a fourth edge 12 of the substrate opposite to the third edge 11.

The ends of the tracks 7 and 10 are situated on the substrate 6 in such a manner as to be substantially facing the resilient tabs 2 and 3 when the substrate 6 is placed on the thin metal sheet.

Before placing the substrate 6 on the metal sheet, solder 13 is deposited at each of the ends of the tracks 7 and 10 over a width corresponding substantially to the width of the corresponding resilient tabs 2 and 3, as shown in FIG. 3.

The thin metal plate and the substrate deposited thereon are then passed through an oven to melt the solder 13 and solder the resilient tabs 2 and 3 to the tracks 7 and 10 of the substrate.

The central symmetry of the cutouts formed in the thin metal sheet to make the resilient tabs 2 and 3 is particularly advantageous since, during melting of the solder 13, it causes the substrate 6 to be automatically centered relative to the resilient tabs 2 and 3 by balancing the surface tension forces of the molten solder.

It should be observed that since the thin metal sheet is in the form of a continuous strip, it is advantageous to provide a continuous manufacturing line comprising a punching station for cutting out the portions 1 from the thin metal strip, a folding station for folding the parts 2 and 3 through right angles, thereby constituting the resilient tabs, a station for placing the substrates between the resilient tabs, and a heater tunnel for soldering the resilient tabs 2 and 3 to the tracks of the substrate.

Once soldering has been performed, it suffices to twist the thin metal sheet slightly to break the breakable connections 4, 5 connecting the resilient tabs 2 and 3 to the remainder of the thin metal sheet.

Figure 4:
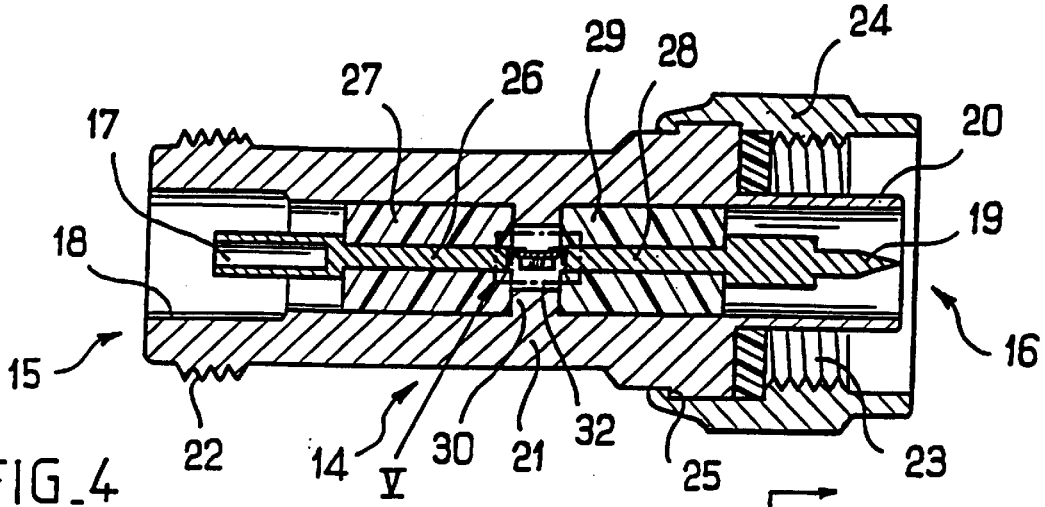
FIG. 4 is an axial section view of a coaxial connector fitted with the FIG. 3 module.
Figure 5:
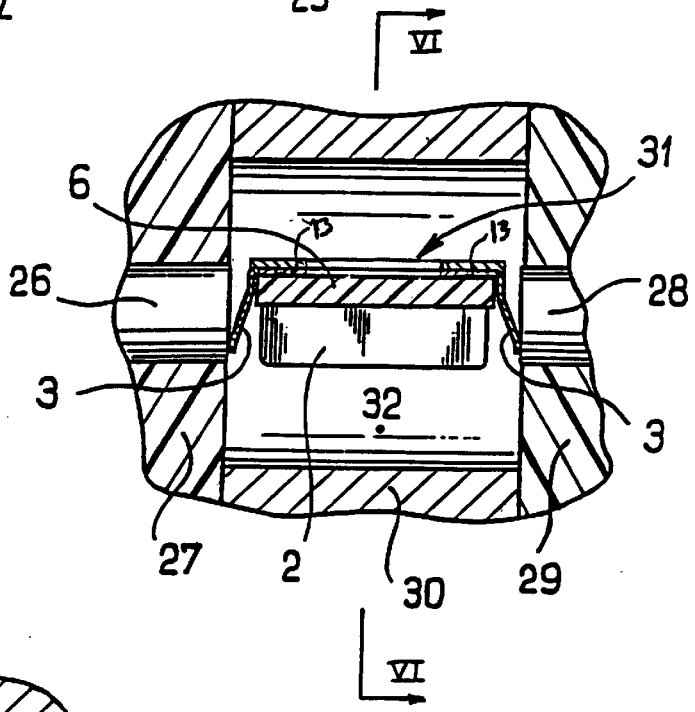
FIG. 5 is a detail view of portion V of FIG. 4.
Figure 6:
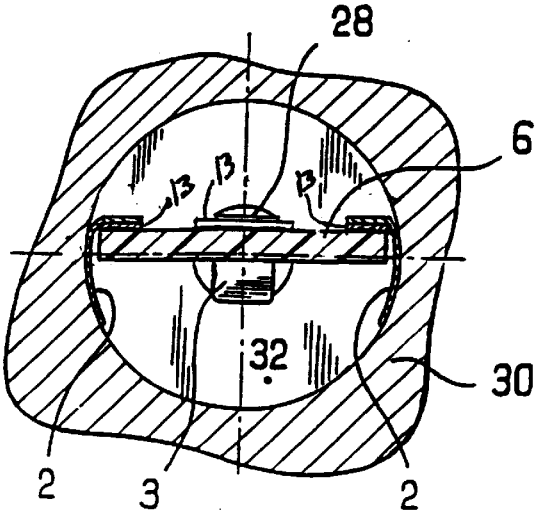
FIG. 6 is a section view on VI—VI of FIG. 5.

A signal processing module is then obtained which can be used as shown in FIGS. 4, 5, and 6.

FIG. 4 shows a coaxial connector 14 designed to be interposed between two connectors (not shown) of a coaxial line.

To this end, the connector 14 has two connection faces 15 and 16.

The connection face 15 has a female central contact 17 and a female outer contact 18, while the connection face 16 has a male central contact 19 and a male outer contact 20.

If not identical with two connectors (not shown) between which the connector 14 is to be interposed, the connection faces 15 and 16 are at least engageable with the connection faces thereof.

This means that the connection faces 15 and 16 are of designs that are suitable for mutual engagement.

The connector 14 has a conductive body 21 which extends from the connection face 15 to the connection face 16 and which constitutes, at respective ends, the female outer contact 18 and the male outer contact 20 of the connector.

At the same end as its connection face 15, the body 21 has a male thread 22 which corresponds to a female thread 23 provided inside a ring 24 engaged around the body 21 at the same end as connection face 16 and retained on said body 21 by an abutment 25.

The female central contact 17 extends into the connector in the form of an electrical conductor 26 which is held inside the body 21 by insulation 27.

Similarly, the male central contact 19 extends into the connector in the form of an electrical conductor 28 which is held inside the body 21 by insulation 29.

Substantially in its central portion, the body 21 includes a rib 30 which constitutes an abutment for the two pieces of insulation 27 and 29.

The electrical conductors 26 and 28 are flush with the faces of the insulation 27 and 29 in abutment against the rib 30.

As can be seen in FIG. 5, the rib 30, the pieces of insulation 27 and 29, and the electrical conductors 26 and 28 thus define a cylindrical cavity 32.

A signal processing module 31 of the type described above is inserted in this cavity.

The resilient tabs 2 of this module which are suitable for deforming so as to move towards each other, extend parallel to the axis of the cavity which coincides with the axis of the connector.

The spread of the module, i.e. the distance between the two furthest-apart points of the two resilient tabs 2 when at rest is slightly greater than the inside diameter of the cavity, which diameter constitutes the largest dimension of the cross-section of the cavity such that when the module 31 is inserted in the cavity, as shown in FIG. 6, the resilient tabs 2 hold the substrate firmly in position in the cavity.

In this way, the resilient tabs 2 replace any fixing means which would otherwise need to be provided in the cavity for holding the substrate in position.

In addition, the resilient tabs 2 serve to connect the track 10 electrically to the conductive body 21 which is itself connected to the outer contacts of the coaxial line.

As can be seen in FIG. 5, the resilient tabs 3 are compressed respectively against the electrical conductor 26 and against the electrical conductor 28, thereby electrically connecting the conductive track 7 of the substrate to the central contacts of the coaxial line.

It will be understood that the above-described module can easily be inserted and held in the cavity 32 while simultaneously providing electrical connections both between the central contacts and the signal processing circuit and between the outer contacts and the signal processing circuit.

In particular, it can be observed that any deformation of the connector 14, regardless of whether the deformation is the result of thermal expansion or of external stress, can easily be absorbed by the resilient tabs 2 and 3, thereby protecting the module from any risk of damage.

It may also be observed that it is not essential for the section of the cylindrical cavity to be circular in shape in order to perform the invention, providing that the resilient tabs 2 can bear against the walls of a cavity and hold the module in place.

Naturally the embodiment described above is not limiting and it could be modified in any desirable manner without going beyond the ambit of the invention.

I claim:

1. A connector element comprising:

a substantially cylindrical inside cavity defining an axis and having a wall, at least one electrical conductor penetrating into said cavity parallel to the axis, a signal processing module enclosed in said inside cavity for processing a signal from said electrical conductor, said signal processing module including:

a substrate having first and second opposed edges spaced along the axis of the cavity, and having third and fourth opposed edges on opposite sides of the axis of the cavity, a circuit formed on the substrate for processing said signal, at least one contact terminal electrically fixedly connected to the signal processing circuit and electrically connected to the electrical conductor such that said signal can pass to the signal processing circuit, said contact terminal being formed on the first or second edge of the substrate, and two resilient tabs, each fixedly connected to one of the third or fourth edges of the substrate, said two resilient tabs being suitable for deforming towards each other, a distance between two furthest-apart points of the two resilient tabs, when at rest, being slightly greater than the largest dimension of a cross-section of the cavity, such that the resilient tabs of the signal processing module are pressed against the wall of the cavity, holding the signal processing module firmly in position in the cavity.

2. A connector element according to claim 1, comprising at least two electrical conductors substantially facing each other about the axis of the cavity and wherein the signal processing module comprises at least two contact terminals, each connected to one of the two electrical conductors, one of said two contact terminals being formed on the first edge of the substrate and the other of said two contact terminals being formed on the second edge of said substrate.

3. A connector element according to claim 1, adapted to be connected in series with a coaxial line having an outer part and a central part, wherein the inside cavity comprises a block of conductive material and is connected to the outer part of the coaxial line, and wherein the electrical conductor is insulated from the cavity and is connected to the central part of the coaxial line.

4. A connector element according to claim 1, wherein said contact terminal is an electrically conductive resilient tab which is pressed against the electrical conductor.

5. A coaxial connector element comprising:

a substantially cylindrical inside cavity defining an axis and having a wall, said cavity comprising a block of conductive material connected to an outer part of a coaxial line, at least two electrical conductors penetrating into said cavity and substantially facing each other about the axis of the cavity, said two conductors being insulated from the cavity and connected to a central part of said coaxial line, a signal processing module enclosed in said inside cavity for processing a signal from the central part of the coaxial line, said signal processing module including:

a substrate having first and second opposite edges spaced along the axis of the cavity, and third and fourth opposed edges on opposite sides of the axis of the cavity, a circuit formed on the substrate for processing said signal, at least two contact terminals fixedly connected to the signal processing circuit, each being electrically connected to one of the two electrical conductors whereby said signal can pass through the signal processing circuit, one of said contact terminals being fixed to the first edge of the substrate and the other one being fixed to the second edge of the substrate, and electrically conductive resilient tabs fixedly connected to the third and fourth edges of the substrate and electrically connected to the signal processing circuit, said resilient tabs being suitable for deforming towards each other, a distance between two furthest-apart points of the two resilient tabs, when at rest, being slightly greater than a largest dimension of a cross-section of the cavity, such that the resilient tabs of the signal processing module are pressed against the wall of the cavity, said resilient tabs connecting the signal processing circuit to the outer part of the coaxial line and holding the signal processing module firmly in position in the cavity.

6. A coaxial connector element comprising:

a substantially cylindrical inside cavity defining an axis and having a wall, said cavity comprising a block of conductive material connected to an outer part of a coaxial line, at least two electrical conductors penetrating into said cavity and substantially facing each other about the axis of the cavity, said two conductors being insulated from the cavity and connected to a central part of said coaxial line, a signal processing module enclosed in said inside cavity for processing a signal from the central part of the coaxial line, said signal processing module including:

a substrate having first and second opposed edges spaced along the axis of the cavity, and third and fourth opposed edges on opposite sides of the axis of the cavity, a circuit formed on the substrate for processing said signal, at least two electrically conductive resilient tabs, fixedly connected to the first and second edges of the substrate and electrically connected to the signal processing circuit, each being pressed against one of the two electrical conductors, whereby the signal of the central part of the coaxial line can pass through the signal processing circuit, and two electrically conductive resilient tabs, each fixedly connected to one of the third and fourth edges of the substrate and electrically connected to the signal processing circuit, said two resilient tabs being suitable for deforming towards each other, a distance between two furthest-apart points of the two resilient tabs, when at rest, being slightly greater than the largest dimension of a cross-section of the cavity, such that the resilient tabs of the module are pressed against the wall of the cavity, said resilient tabs connecting the signal processing circuit to the outer part of the coaxial line and holding the substrate firmly in position in the cavity.

* * * * *